United States Patent [19]

Berntell et al.

[11] 4,396,057

[45] Aug. 2, 1983

[54] PLATE HEAT EXCHANGER

[76] Inventors: John O. Berntell, Bagarevägen 10, S-245 00 Staffanstorp; Rolf W. Jennfors, Leif väg 29, S-230 50 Bjärred; Yngve R. Kihlberg, Ingelstadsvägen 47, S-230 47 Åkarp; Johan E. P. Sjöholm, Löjtnantsvagen 49, S-230 50 Bjärred, all of Sweden

[21] Appl. No.: 280,370

[22] Filed: Jul. 6, 1981

Related U.S. Application Data

[63] Continuation of Ser. No. 971,728, Dec. 21, 1978, abandoned.

[30] Foreign Application Priority Data

Dec. 31, 1977 [GB] United Kingdom ..... 54402/77

[51] Int. Cl.[3] ..... F28D 17/00

[52] U.S. Cl. ..... 165/4; 165/166

[58] Field of Search ..... 165/157, 166, 7, 4; 60/39-57

[56] References Cited

U.S. PATENT DOCUMENTS

| | | | |
|---|---|---|---|
| 2,617,634 | 11/1952 | Vendrassik | 165/167 |
| 3,015,475 | 1/1962 | Meiver et al. | 165/166 |
| 3,240,268 | 3/1966 | Armes | 165/167 |
| 3,291,206 | 12/1966 | Michulson | 165/166 |

*Primary Examiner*—William R. Cline
*Assistant Examiner*—Theophil W. Streule, Jr.
*Attorney, Agent, or Firm*—Finnegan, Henderson, Farabow, Garrett & Dunner

[57] ABSTRACT

A plate-type heat exchanger for hot gas engines of the Stirling type includes stacked pairs of elongated rectangular plates joined at the longitudinal edges with spaces between the paired plates constituting the cold gas flow passages and spaces between plate pairs constituting the hot gas flow passages. Paired plates have mirror image protrusions protruding from the respective abutted longitudinal margins, which protrusion form the internal cold gas flow passages and also provide the spacing between adjacent abutting pairs that constitutes the hot gas flow passages. Abutting plates of adjacent stacked pairs are joined at the abutting transverse margins.

5 Claims, 9 Drawing Figures

Fig. 1
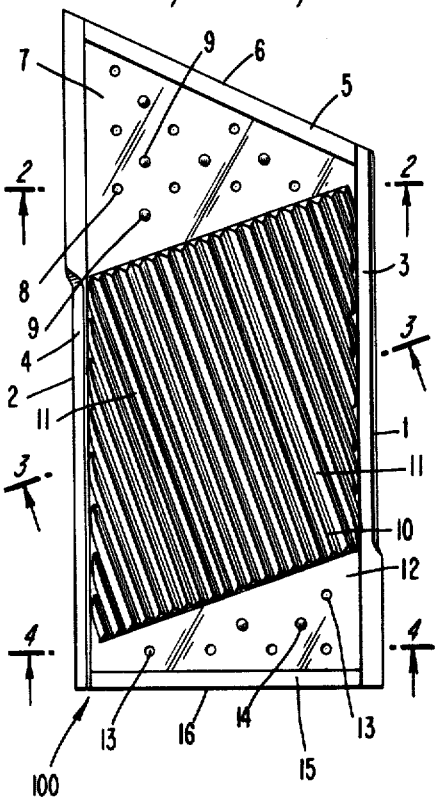
Fig. 2
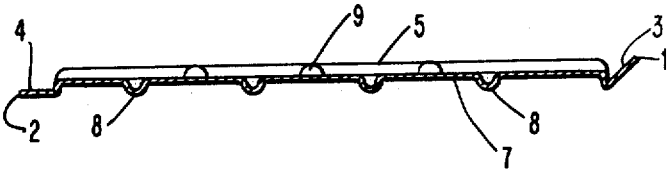
Fig. 3
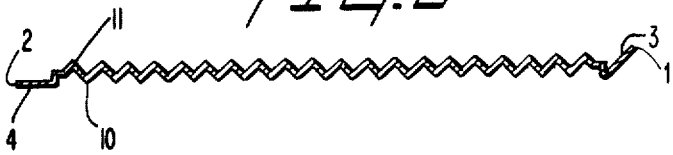
Fig. 4
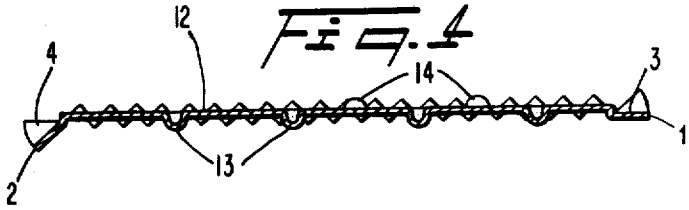
Fig. 5
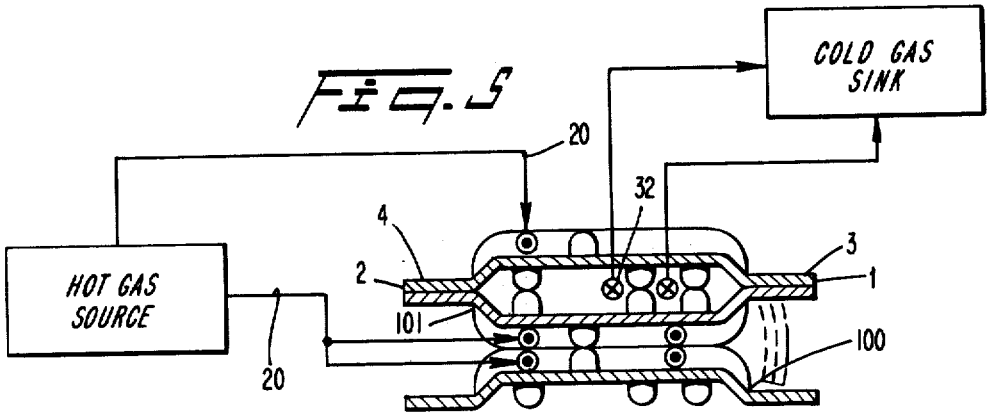
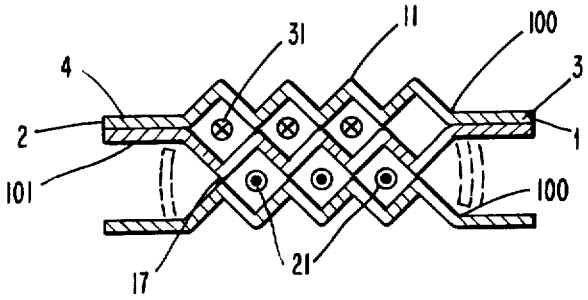
Fig. 6

PLATE HEAT EXCHANGER

This is a continuation of application Ser. No. 971,728, filed 12/21/78, now abandoned.

This invention relates to a heat-exchanger of the kind (herein called "the kind defined") comprising a plurality of plates each formed with protruding portions protruding respectively on opposite sides of a body of the plate, the plates being placed side-by-side in contact with one another so that at least some of the protruding portions of each plate contact those of an adjacent plate and define at least two sets of passages through which gaseous or other fluids can flow separately for the transfer of heat through the plates from one of said fluids to another.

Heat-exchangers of the kind defined are often called plate heat-exchangers in order to distinguish them from others which consist mainly of tubes.

It is advantageous to use a heat-exchanger of the kind defined to pre-heat combustion air flowing to a combustion chamber of a heat engine, for example a hot gas engine.

One object of the invention is to facilitate the construction of a heat-exchanger of the kind defined suitable for a hot gas engine and not unduly heavy or complicated.

According to the invention a heat-exchanger of the kind defined is characterised in that each plate has two substantially parallel longitudinal edges adjacent to which are longitudinal marginal protruding portions and in the heat-exchanger the plates are in pairs in each of which the said marginal portions of the two plates are in fluid-tight contact with each other and one of said sets of passages is formed between the two plates, and another one of said sets of passages is formed between each two adjacent pairs, and all of said passages extend approximately in the longitudinal direction of the plates.

Preferably each plate has two transverse edges adjacent to which are transverse marginal protruding portions, and the transverse marginal protruding portions of the two plates in each of said pairs are in fluid-tight contact with the transverse marginal protruding portions of two other plates one in each of two other pairs.

In one heat-exchanger well suited for use with a hot gas engine the plates are disposed in a ring with their longitudinal edges in two imaginary co-axial right-cylindrical surfaces, the plates being curved so that as viewed along the common axis of the said surfaces they conform substantially to involute curves between the surfaces.

How the invention may be put into practice appears from the following description with reference to the accompanying schematic drawings, in which:

FIG. 1 shows one plate of a heat-exchanger according to the invention,

FIG. 2 is a view in section along the line II—II of FIG. 1,

FIG. 3 is a view in section along the line III—III of FIG. 1,

FIG. 4 is a view in section along the line IV—IV of FIG. 1,

FIG. 5 is a view in section through three juxtaposed plates, the section as along the line II—II, FIGS. 6 and 7 are respectively views in section along the lines III—III and IV—IV through the said juxtaposed plates.

Figure 7:
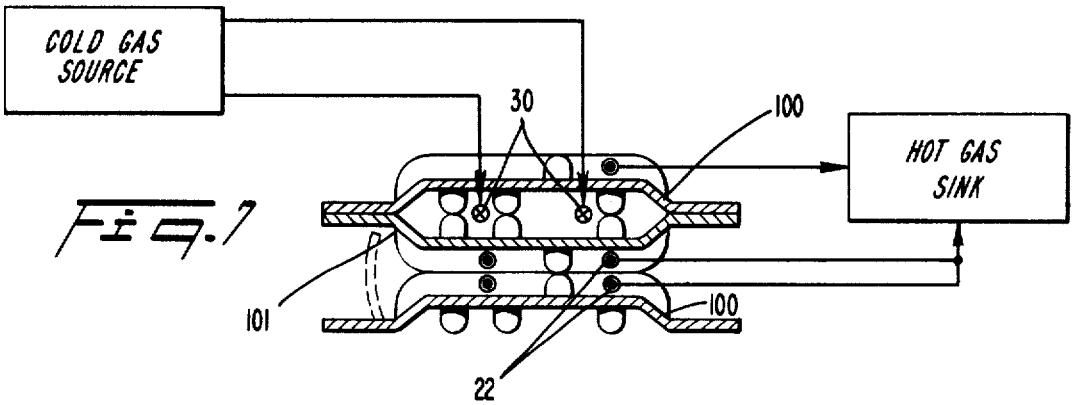

The drawings show a plate 100 made of thin metal sheet, with two parallel longitudinal edges 1 and 2. Two longitudinal marginal protruding portions 3 and 4 of plate 100 extend near the edges 1 and 2 while the remaining parts of the plate protrude in one direction to at least two different levels. One transverse marginal protruding portion 5 is located adjacent to a transverse top edge 6 of the plate, this portion 5 protruding to a maximum extent compared with the portions 3 and 4. A substantially triangular protruding portion 7 adjacent to the portion 5 protrudes to a lesser extent, and therein hollow knobs 8 are formed by locally making depressions in the direction opposite to protruding portion 7 and hollow knobs 9 are made locally to protrude to the same maximum level, and in the same direction as the portion 5, as shown in FIG. 2.

Adjoining the portion 7 of the plate 100 there is an area 10 provided with inclined narrow protruding portions 11 extending to the same extent as the portion 5. Adjoining the portion 10 is a triangular protruding portion 12 made by deformation depression to a lesser degree than that of the portions 11 and 5, but not necessarily to the same extent as the triangular portion 7. Said triangular portion 12 is provided with hollow knobs 13 and 14 made in the same way as the knobs 8 and 9. A transverse marginal portion 15 adjacent to a transverse lower edge 16 of the plate protrudes to the same extent as the portion 5 relative to the portions 3 and 4.

FIGS. 5, 6 and 7 show how two plates 100 have been stacked together with a plate 101 sandwiched between the plates 100. The plate 101 has the same general outline shape as the plate 100 but all protruding portions extend in the opposite directions relative to the main body of the plate, and thus the inclined narrow portions 17 of plate 101 (see FIG. 6) cross the portions 11 of the plate 100, the portions 17 of plate 101 constituting a mirror image of portions 11 of plate 100. In FIGS. 5 and 6, the upper plate 100 and the plate 101 constitute a pair of which the longitudinal marginal portions are in fluid-tight contact with each other.

After the stacking of the plates 100 and 101 the edges 1 of the two plates in each pair of plates 100 and 101 in which the marginal portions abut each other are welded together. Also the edges 2 are welded together in each of the said pairs.

Each pair thus formed contacts two neighbouring pairs, one on each side, along the portions 5 and 15, and the edges 6 and 16 are welded together where in contact.

As shown in dotted lines in FIGS. 5, 6 and 7, the marginal portions 3 and 4 may be bent through about 90 degrees, in order to provide sealing means, with the aid of additional welding or other elements (not shown) if necessary.

The stack of plates 100 and 101 thus form a heat-exchanger in which hot gases from a common gas source can enter through an inlet plenum 20 between each two plates of adjacent pairs that face and contact each other along the portions 5 at the upper parts and 15 at the lower parts of said plates—see FIGS. 1 and 5. The flow of hot gas will continue downwards through passages 21—see FIG. 6. Finally the hot gases leave the heat-exchanger and flow to a common hot gas sink through a outlet plenum 22 between each two facing and contacting plates of adjacent pairs—see FIG. 7. This outlet plenum 22 may advantageously be somewhat wider than the inlet plenum 20. The said difference is obtained by depressing the portion 12 to a lesser degree than the portion 7. In tests this has proved to give a more uniform distribution of the gas flow through the passages 21.

The cold gas flow enters from a common cold gas source between the lower ends of the plates in the stack through inlet plenum 30 formed between paired plates contacting each other along the marginal portions 3 and 4, as seen in FIG. 7. The flow runs upwards through passages 31 between paired plates 100 and 101, as shown in FIGS. 5 and 6 and through outlet plenum 32 past the top ends of the plates to a common cold gas sink.

As can be appreciated from the Figures, in particular FIGS. 5, 6, and 7, the flow of the colder gas into and out of inlet plenum 30 and outlet plenum 32, respectively, occurs past the respective transverse edges 16 and 6 generally parallel to the longitudinal direction. Flow of the hotter gas stream into inlet plenum 20 and out of outlet plenum 22 occurs past the logitudinal edges 2 and 1, respectively, and is thus generally perpendicular to the longitudinal plate direction.

Figure 8:
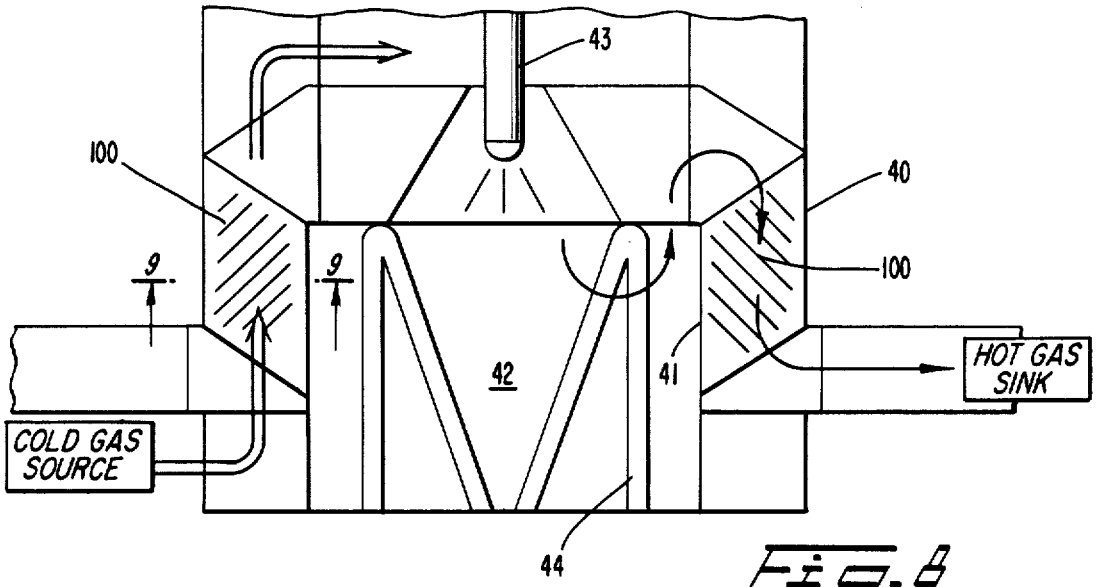
FIG. 8 is a vertical axial section through a heat-exchanger according to the invention.
Figure 9:
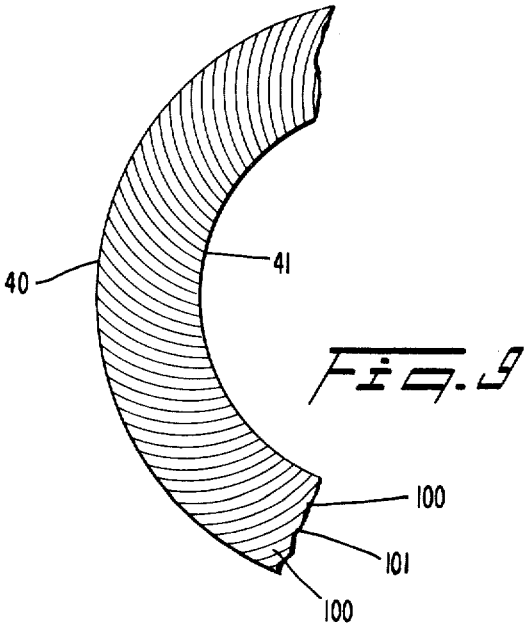
FIG. 9 is a view in section along the line IX—IX of FIG. 8.

As shown in FIGS. 8 and 9 the stack of plates 100 and 101 can be disposed in a ring located between an outer cylindrical surface 40 and in inner cylindrical surface 41. The heat-exchanger thus formed surrounds a combustion chamber 42 in which fuel supplied through a nozzle 43 reacts with preheated air, the flow of which through the heat-exchanger acting as a preheater is indicated by double arrows. The combustion gases formed pass between tubes 44 and escape via the plate heat-exchanger acting as the preheater, their path being shown by single arrows.

FIG. 9 shows how the plates of the heat-exchanger acting as the preheater are curved along involute curves in order to ensure that the distance between the plates is constant, when viewed along the common axis of the cylindrical surfaces 40 and 41, which are co-axial and may be imaginary.

As viewed in FIG. 6 in cross-section at right-angles to the passages 21 and 30 the plates 100 and 101 have zig-zag formations and the passages 21 and 30 are of approximately square cross-section.

What we claim is:

1. An improved heat-exchanger of the kind including a plurality of plates each having two longitudinal edges and two transverse edges, and each formed with protruding portions, the plates being placed side-by-side in contact with one another so that at least some of the protruding portions of each plate contact those of an adjacent plate, the plates defining at least two sets of passages through which gaseous or other fluids can flow separately for the transfer of heat through the plates from one of said fluids to another, the improvement comprising plates of a first type;

plates of a second type, said second type plates being mirror images with respect to the position and orientation of the protruding portions of said first type plates, and said first type plates and said second type plates being arranged in alternating order;

unprotruded longitudinal marginal portions adjacent the longitudinal edges of each plate, said longitudinal marginal portions of each plate being in continuous abutting contact with the respective longitudinal marginal portions of one of the two immediately adjacent plates for spacing said one adjacent plate, the plates having abutting longitudinal marginal portions forming a representative pair, wherein the protruding portions in each plate consist of protrusions protruding to a first degree and protrusions protruding to a second degree, the protrusion distance corresponding to the first degree being one-half the protrusion distance of the second degree, the protrusion distance being defined from said longitudinal marginal portions, all the protrusions in each plate lying entirely to one side of said longitudinal marginal portions;

said protrusions including a plurality of parallel elongated protrusions of said second degree oriented generally in the longitudinal direction and forming between the paired plates one of the at least two sets of passages the elongated protrusions on adjacent plates being parallel;

said protrusions also including other protrusions protruding to said second degree, said other protrusions together with said elongated protrusions being in continuous abutting contact with like protrusions in adjacent plate pairs for spacing adjacent pairs, another one of the at least two sets of passages being formed between each two spaced adjacent pairs by said elongated protrusions, all of said passages extending generally in the longitudinal direction of the plates;

and said protrusions further including planar protrusions to said first degree in each of the plates, said planar protrusions in adjacent plates forming at least two sets of plenums, one set associated with each of said sets of passages, each of said plenum sets comprising an inlet plenum and an outlet plenum, said inlet and outlet plenums being positioned proximate opposite transverse edges of the plates forming the respective set of flow passages, the fluid flow to the plenums associated with said one passage set entering and leaving the respective inlet and outlet plenums past a respective transverse edge, said plenums associated with said one set being formed between the planar protrusions of the paired plates, and the fluid flow to said another passage set entering and leaving the respective inlet and outlet plenums past a respective longitudinal edge, said plenums of said another passage set being formed between said planar protrusions of adjacent plate pairs.

2. A heat-exchanger according to claim 1, wherein said other protrusions are transverse marginal protrusions adjacent the transverse edges, and wherein the transverse marginal protrusions of the two plates of a respective pair are in continuous abutting contact with the respective transverse marginal protrusions of two other paired plates, one in each of the two pairs adjacent said representative pair, one on each side.

3. A heat-exchanger according to claim 1, wherein the plates are disposed in a ring with their longitudinal edges respectively disposed in two imaginary co-axial right-cylindrical surfaces, the plates being curved so that as viewed along the common axis of the said surfaces they conform substantially to involute curves between said imaginary surfaces, the flow of fluids in said sets of passages being approximately parallel to the common axis and perpendicular to the direction of curvature.

4. A heat-exchanger according to claim 1, wherein the contacted longitudinal marginal portions in each pair are bent to extend towards an adjacent pair of plates.

5. A heat-exchanger according to claim 1, wherein each of said planar protrusions includes unprotruded areas and areas protruding to the second degree for contacting like areas on paired plates and plate pairs, respectively.

* * * * *